United States Patent [19]

Brown, Jr.

[11] 4,137,592

[45] Feb. 6, 1979

[54] MOP WITH A WRINGER ROLLER

[76] Inventor: Arthur K. Brown, Jr., 1640 N. Kenmore, South Bend, Ind. 46628

[21] Appl. No.: 864,373

[22] Filed: Dec. 27, 1977

[51] Int. Cl.[2] ..... A47L 13/144

[52] U.S. Cl. ..... 15/119 A

[58] Field of Search ..... 15/116 R, 116 A, 119 R, 15/119 A

[56] References Cited

U.S. PATENT DOCUMENTS

| | | | |
|---|---|---|---|
| 1,137,760 | 5/1915 | Kawasaki | 15/119 R |
| 2,073,726 | 3/1937 | Bates | 15/119 A |
| 2,194,150 | 3/1940 | Price | 15/119 A |
| 2,735,126 | 2/1956 | Proffitt | 15/119 A X |

FOREIGN PATENT DOCUMENTS

| | | | |
|---|---|---|---|
| 465420 | 9/1951 | Italy | 15/119 A |
| 583111 | 10/1958 | Italy | 15/119 A |
| 514422 | 11/1939 | United Kingdom | 15/119 A |

*Primary Examiner*—Daniel Blum
*Attorney, Agent, or Firm*—Leo H. McCormick, Jr.

[57] ABSTRACT

A mop having a cylindrical core fixed to a handle by a fastener member. An absorbent material is attached to the cylindrical core. A U-shaped bracket has first and second legs attached to the cylindrical core by first and second pins. A roller is positioned a predetermined distance from the cylindrical core by third and fourth pins extending through the first and second legs. A resilient edge on the absorbent material holds the roller adjacent the handle. An input force applied to the U-shaped bracket moves the roller in an arc about the first and second pins to allow the roller to engage and compress the absorbent material and thereby remove material absorbed therein.

10 Claims, 10 Drawing Figures

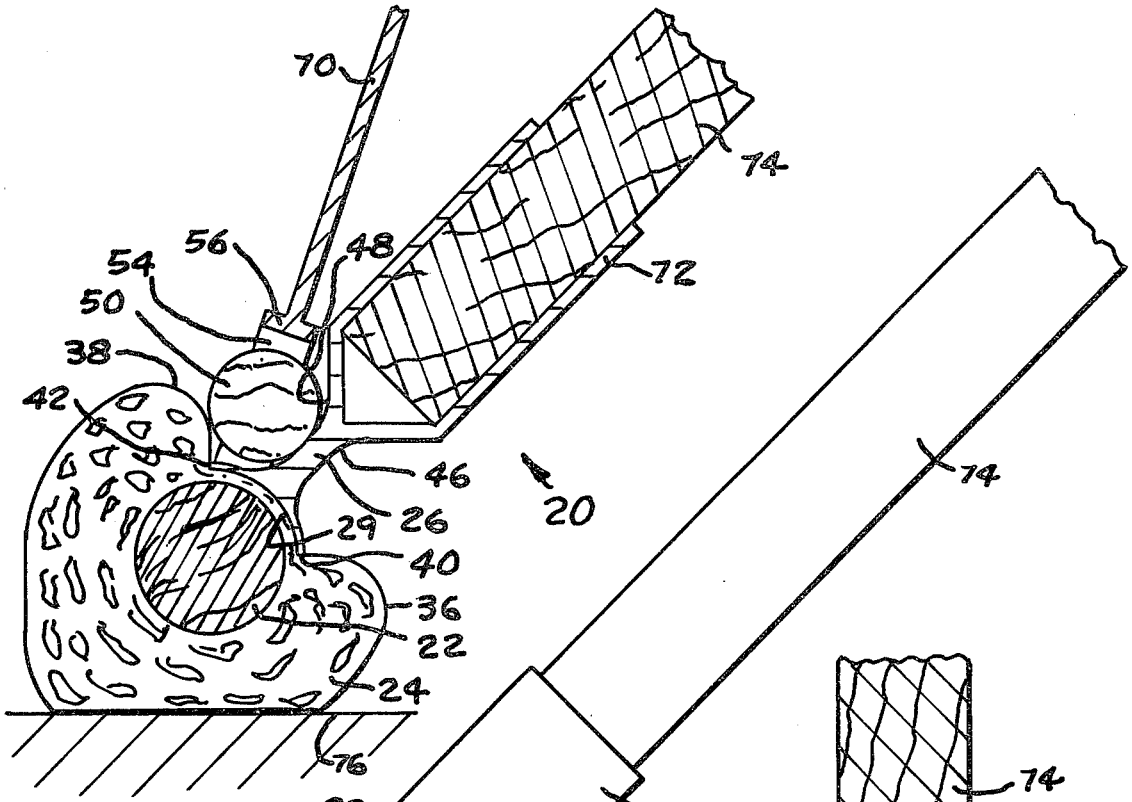
FIG. 3
FIG. 1
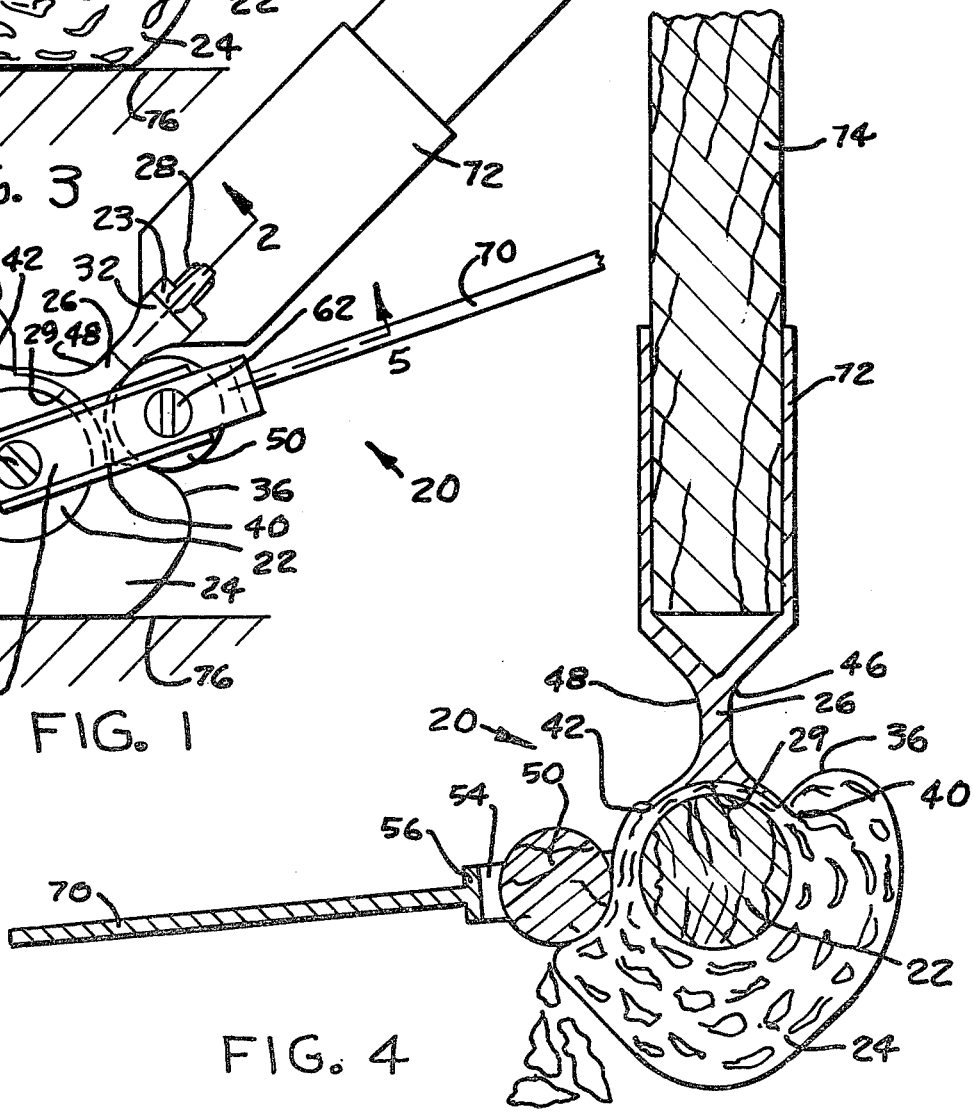
FIG. 4

MOP WITH A WRINGER ROLLER

BACKGROUND OF THE INVENTION

This invention relates to a mop having a handle fixed to a cylindrical core covered with an absorbent material. A roller member carried by a bracket pivotally fixed to cylindrical core is held adjacent the handle by the absorbent material. When the bracket is rotated about the cylindrical core, the roller engages and compresses the absorbent material to remove any material absorbed therein.

The prior art relating to mops with roller wringers is best illustrated by the disclosures in U.S. Pat. Nos. 2,073,726 and 2,194,150.

In U.S. Pat. No. 2,073,726 an absorbent cover which surrounds a cylinder core rotates in only one direction to apply an absorbed material to a surface while a brake holds the roller stationary to permit the absorbed material to be spread on the surface. When the absorbent cover is wrung dry, a roller carried by a slotted bracket is moved in an arc about the cylindrical core to compress the absorbent cover. However, to completely remove material absorbed by the cover, several roller engagements are required since the cylindrical cover must be rotated to bring a new surface into position for engagement with the roller.

In U.S. Pat. No. 2,194,150 an absorbent cover is compressed by a resiliently positioned roller carried by a frame eccentrically positioned on a cylindrical core. The eccentrical positioned frame prevents the resiliently positioned roller from uniformily engaging the absorbent cover. Thus the cover is never completely wrung dry.

The ability of a mop to clean a floor is dependent on how well an absorbent cover can be wrung dry. It is necessary that substantially all the unclean water be removed from the floor and deposited in a bucket rather than being spread around on the floor. Thus, it is essential that a mop be capable of being repeatably wrung dry during each clearing operation.

SUMMARY OF THE INVENTION

I have devised a mop having a cylindrical core with an absorbent cover which is substantially wrung dry with a single engagement by a wringer roller.

A bracket pivotally attached to the cylindrical core positions the wringer roller at a fixed distance from the cylindrical core. The absorbent cover engages and holds the roller in a recess located in a web through which a handle is fixed to the cylindrical core. When a rotative input force is applied to the bracket, the roller engages the absorbent cover and applies a substantially uniform compressive force to remove substantially the entire amount of any material absorbent therein with a single engagement.

It is, therefore, the object of this invention to provide a mop with a wringer arrangement which substantially removes an absorbed material from an absorbent cover with a single engagement.

It is another object of this invention to provide a mop having a wringer roller with an absorbent cover which holds the wringer roller in a recess of a fastener through which a handle is fixed to a cylindrical core.

These and other objects should be apparent from reading the following specification while viewing the drawing.

BRIEF DESCRIPTION OF THE DRAWINGS

FIG. 1 is a side view of a mop with a wringer-roller made according to the principals of this invention;

FIG. 3 is a sectional view taken along line 3—3 of FIG. 2;

FIG. 4 is a sectional view of FIG. 3 illustrating the engagement of the roller with an absorbent cover;

DETAILED DESCRIPTION OF THE INVENTION

Figure 6:
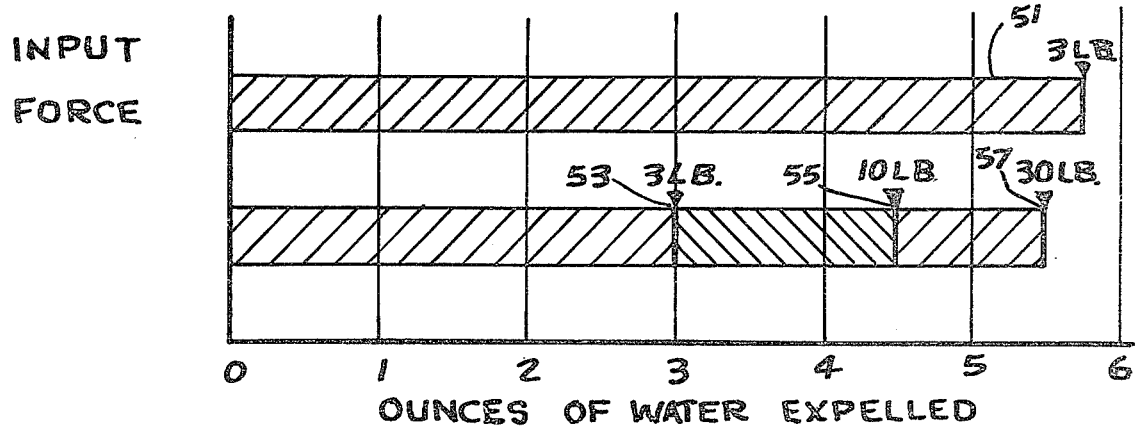
FIG. 6 is a graph comparing the effort required to remove material from the absorbent material through this invention and by a typical clamp type mop.

The mop 20 shown in FIG. 1 has a cylindrical core 22 to which an absorbent, resilient cover material 24 has been attached. A web member 26 has a bar with an arcuate face 29 that is substantially concentric to the cylindrical core 22. The web member 26 is attached to the cylindrical core 22 by the engagement of wing nuts 23 and 27 with web supports 32 and 34 as the wing nut is mated with bolts 28 and 30, respectively. The arcuate surface 29 engages and compressing the absorbent cover causing resilient edges 36 and 38 to be created adjacent edges 40 and 42 on the arcuate surface 29.

Figure 2:
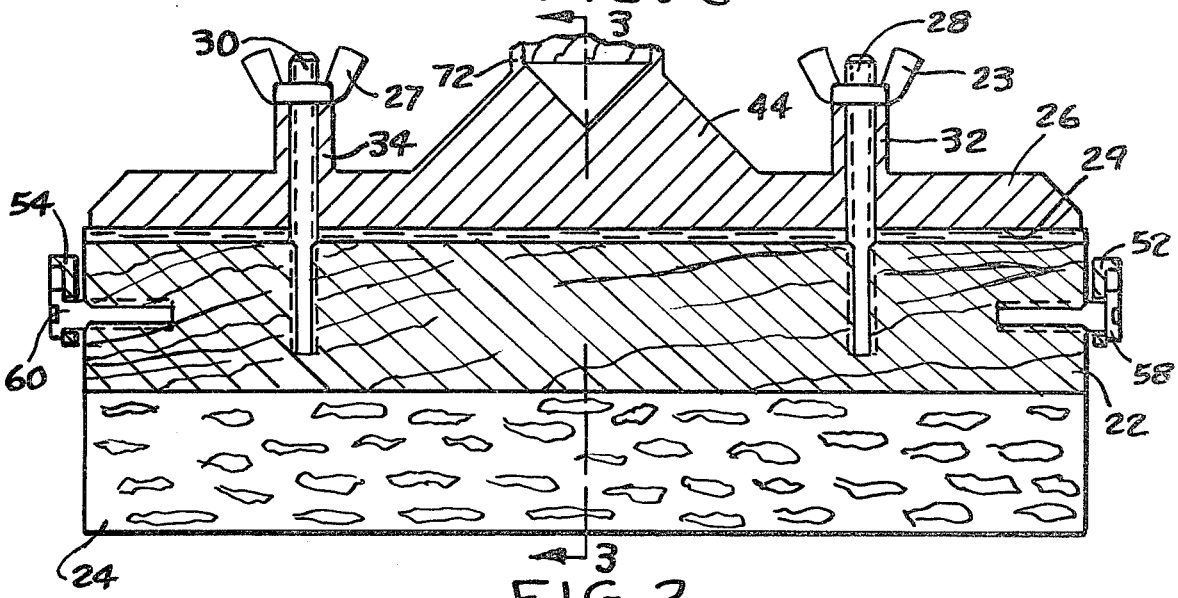
FIG. 2 is a partial front sectional view taken along line 2—2 of FIG. 1.

The web member 26 which includes the web support 44, is best shown in FIG. 2. The web member 26 has recesses 46 and 48 that are parallel to edges 40 and 42. Recesses 46 and 48 are designed to retain a roller member 50. The roller member 50 is held in recesses by the resiliency of edges 36 and 38.

A U-shaped bracket has a first leg 52 separated from a second leg 54 by a spacer bar 56. A first pin 58 which passes through leg 52 and a second pin 60 which passes through leg 54 pivotally attaches the U-shaped bracket to the cylindrical core 22.

Figure 5:
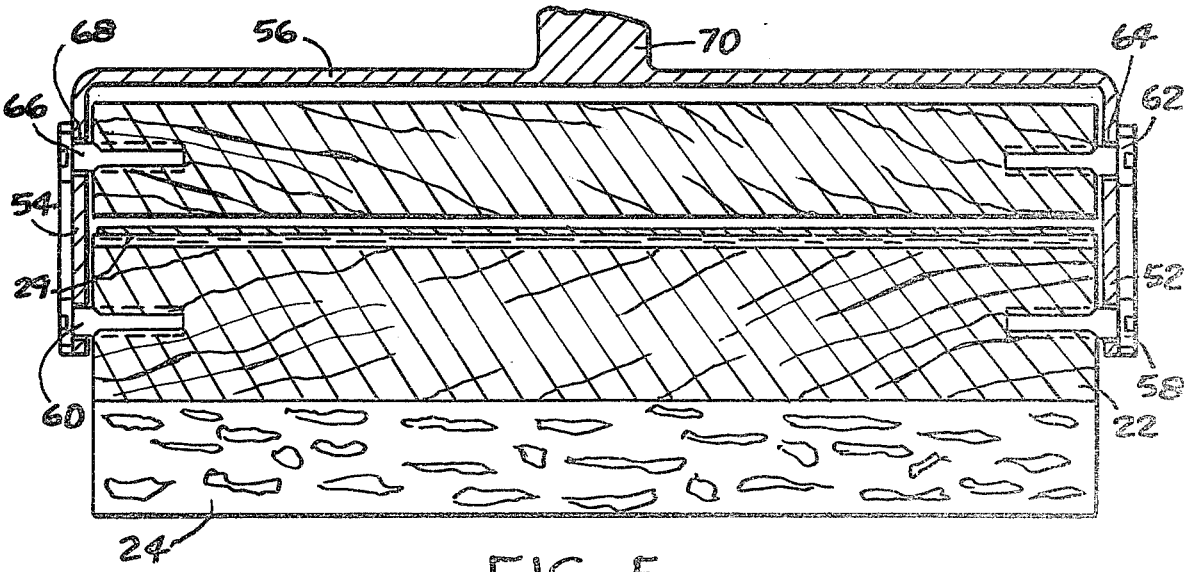
FIG. 5 is a sectional view taken along line 5—5 of FIG. 1.

A first roller pin 62 passes through bearing surface 64 in the first leg 52 and a second roller pin 66 passes through bearing surface 68 to position roller 50 a fixed distance from the cylindrical core 22. As shown in FIGS. 3 and 5 the roller 50 does not engage the edges 40 or 42 and, therefore, the roller 50 does not pinch the absorbent cover upon rotation of the U-shaped bracket about the pivot pins 58 and 60 in response to an input force applied to handle 70.

The web member 26 has a cylindrical projection 72 extending from the center thereof for attaching a handle 74 to the cylindrical core 22.

MODE OF OPERATION OF THE INVENTION

During normal mopping operation, roller 50 is held in one of the recesses 46 and 48 by the resilient engagement with edges 36 and 38. The absorbent cover material 24 engages a surface 76 to remove any absorbable material thereon. Because of the positioning of roller 50 in a recess, the handle 70 does not interfere with the use of substantially the entire absorbent cover material 24.

When it is desired to remove the absorbent material from the cover material 24, an input force is applied to handle 70 to rotate the U-shaped bracket around the cylindrical core 22. The roller 50 engages the cover material and compresses the same to remove the absorbed material therefrom in a manner as illustrated in FIG. 4.

Since the roller 50 is positioned at a fixed distance from the cylindrical core 22, removal of the absorbed material from the cover material is substantially uniform.

In order to evaluate the effectness of the wringer roller arrangement of mop 20 of this invention, a controlled efficiency test was performed through the following steps.

The cover material was saturated with 6 fluid ounces of water. Thereafter 3 pounds of force was applied to handle 70 causing U-shaped bracket to move roller 50 into engagement with the cover material 24. The water removed was collected and measured, approximately 5.7 fluid ounces or approximately 95 percent recovery rate, as illustrated by line 51 in FIG. 6.

Thereafter, a typical clamp type sponge mop was saturated with 6 fluid ounces of water. 3 pounds of force was applied to this clamp type wringer and 3 fluid ounces of water were removed. Thus the recovery rate with this clamp type mop is only approximately 50 percent, see line 53 in FIG. 6, of the roller mop of this invention.

Thereafter, the input force was increased to 10 pounds and an additional 1.5 fluid ounces of water was removed from the sponge of this clamp type mop. However, even with 10 pounds of force, the recovery rate is only a 75 percent as illustrated by line 55 in FIG. 6, of the roller mop of this invention.

To evaluate the ultimate recovery from such clamp type mops, 30 pounds of force was applied to the clamp handle resulting in an additional ounce of water removal. With the maximum force applied to the clamp type mop, an ultimate recovery rate as compared to the roller mop of this invention is of only approximately 91 percent, as illustrated by point 57 in FIG. 6. Thus even with an input force 10 times the force required to achieve a 95 percent efficiency with the wringer roller mop 20 illustrated in FIG. 1 a clamp type mop is not as effecitve in removing water from an absorbent material.

Figure 7:
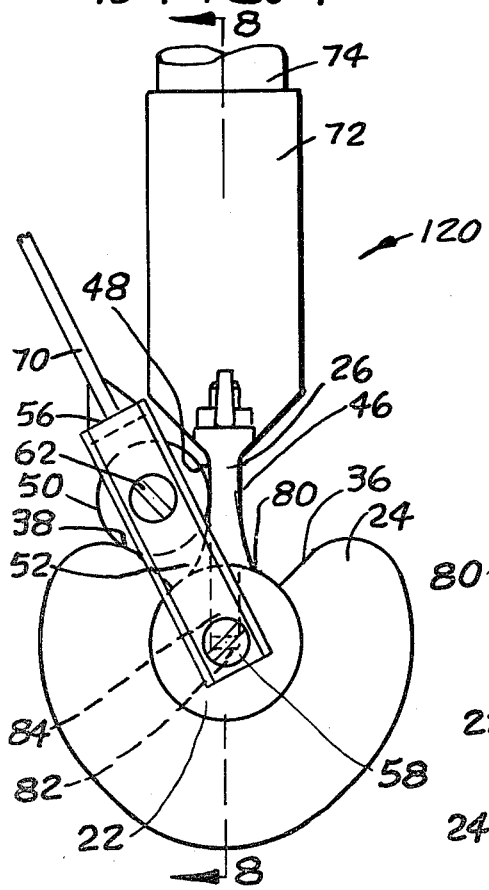
FIG. 7 is an end view of a second embodiment of a mop with a wringer roller of this invention.
Figure 8:
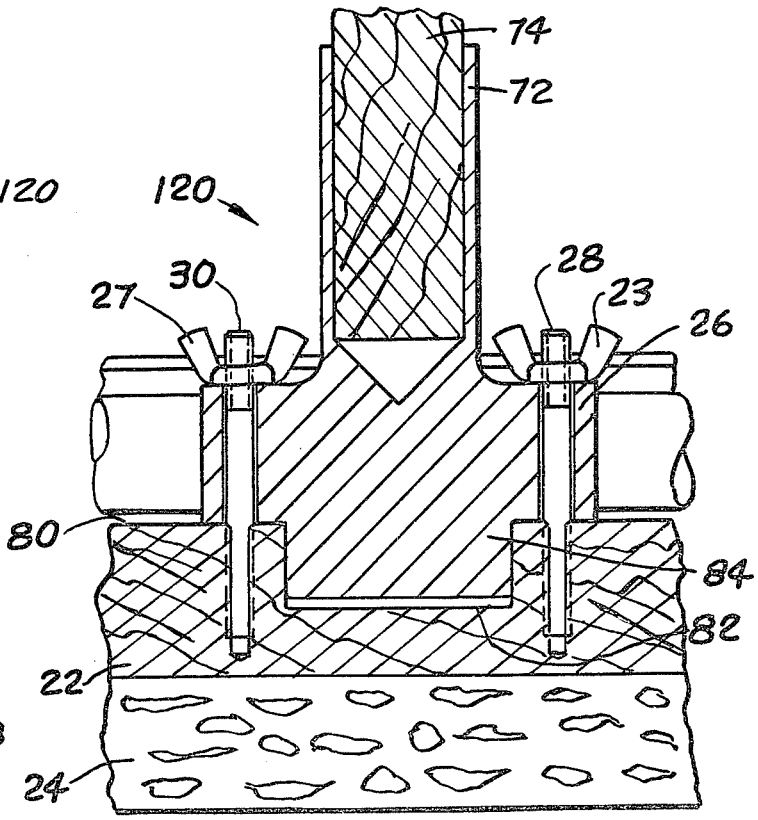
FIG. 8 is a partial front section view taken along line 8—8 in FIG. 7.

The embodiment of the invention illustrated in FIG. 7, has a mop 120 wherein the absorbent material 24 is directly applied to a portion (approximately 270°) of the peripherical surface 80 of the cylindrical core 22. The cylindrical core 22 has a recess 82 located in the approximate center thereof for receiving projection 84 of web member 26.

The web member 26 is attached to the cylindrical core 22 through wing nuts 23 and 27 and bolts 28 and 30. The handle 74 is located in cylindrical projection 72 to secure the handle to the cylindrical core 22.

As with mop 20 in FIG. 1, the roller 50 in mop 120 of FIG. 7 is held in recesses 46 and 48 by resilient edges 36 and 38 in the absence of an input force to handle 70. However, the removal of the absorbed material through the engagement of roller 50 with cover material 24 is exactly the same as with mop 20 in FIG. 1.

Figure 9:
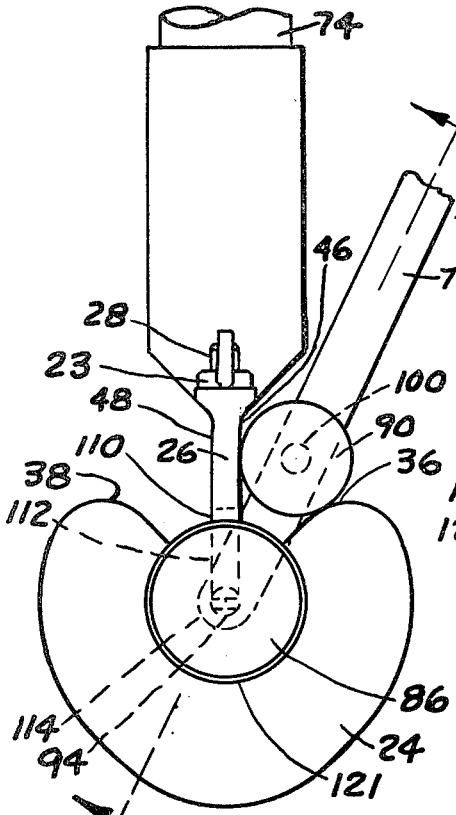
FIG. 9 is an end view of a third embodiment of a mop with a wringer roller of this invention.
Figure 10:
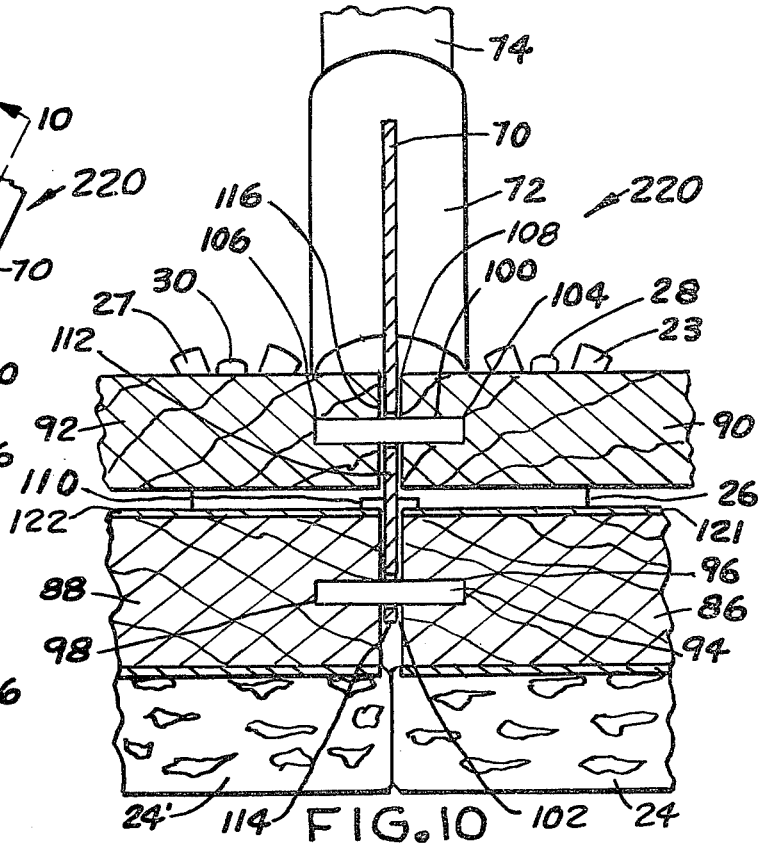
FIG. 10 is a partial section view taken along line 10—10 of FIG. 9.

The embodiment of the invention illustrated in FIG. 9 has a mop 220 wherein the cylindrical core 22 is divided into a first member 86 and a second member 88, and the roller is divided into a first section 90 and a second section 92. A pin 94 located in bores 96 and 98 joins the first member 86 to the second member 88 to form a unitary cylindrical core structure with a fixed groove 102 therebetween.

Similarly, a pin 100 located in bores 104 and 106 join the first member 90 with the second member 92 to form a unitary roller with a groove 108 therebetween.

The web member 26 has a slot 110 located adjacent groove 102 formed in the cylindrical core for allowing rectangular plate 112 of the bracket to position rollers 90 and 92 adjacent recesses 46 and 48 in response to engagement with resilient edges 36 and 38. Rectangular plate 112 which has an end 114 secured to pin 94 has a bearing surface 116 located at a fixed position from pin 94.

Whenever an operator applies an input force to handle 70, rectangular plate 112 rotates about pin 94 while rollers 90 and 92 rotate on pin 100 and engage absorbent surface 24 to remove absorbed material therefrom.

It should be noted that in the absorbent cover 24 of mop 220 in FIG. 9 is mounted on cylinders 121 and 122 which are adapted to slide on cylindrical cores 86 and 88. Thus, mop 220 could be constructed of a single plastic member and then whenever the absorbent covers 24 and 24' become worn could be replaced easily.

I claim:

1. A mop comprising:

a cylindrical core means;

a resilient absorbent material attached to and covering the greater portion of said cylindrical core means;

a first handle attached to said cylindrical core means and extending substantially perpendicular thereto in the plane thereof;

first pin means connected to said cylindrical core means;

bracket means pivotally connected to said cylindrical core means through said first pin means;

second pin means rotatably carried by and located on said bracket means a fixed distance from said first pin means and substantially parallel thereto; and roller means secured to said second pin means and extending substantially parallel to the core means, said absorbent material forming first and second resilient edges for holding said roller means adjacent said first handle on opposite sides thereof between a respective resilient edge and the first handle, said bracket means responding to an input force by overcoming the holding force of one of said first and second resilient edges and moving in an arc about said first pin means causing said roller means to rotate with said second pin means and uniformily compress said absorbent material to remove any absorbed material located therein.

2. The mop recited in claim 1 further including:

a web member located therebetween said first handle and said cylindrical core means; and fastener means for securing said web member to said cylindrical core means, said web member having first and second longitudinal recesses thereon substantially parallel to said cylindrical core means for retaining said roller means in an absence of an input force.

3. The mop, as recited in claim 2, wherein said absorbent material is fixed to approximately 270° of the peripherial surface of said cylindrical core means, said absorbent material engaging and holding said roller means in one of said first and second longitudinal recesses.

4. The mop, as recited in claim 2, wherein said absorbent material surrounds said cylindrical core means, said web member when attached to said cylindrical core means compressing said absorbent material to a predetermined density to create said resilient edges adjacent said web, said resilient edges engaging and holding said roller in one of said first and second longitudinal recesses.

5. The mop, as recited in claim 1, wherein said bracket means includes:

a first leg;

a second leg;

spacer means for separating said first leg from said second leg to establish a U-shaped structure; said first pin means attaching said first and second legs to said cylindrical core means, said second pin means attaching said roller means to said first and second legs; and a second handle attached to said spacer means for moving said roller into engagement and in said arc about said cylindrical core.

6. The mop as recited in claim 4, wherein said cylindrical core means includes:

a first member; and a second member, said first pin means connecting said first member to said second member to establish a first unitary structure.

7. The mop, as recited in claim 6, wherein said roller means includes:

a first section;

a second section, said second pin means connecting said first section to said second section to establish a second unitary structure.

8. The mop, as recited in claim 4, wherein said web member includes:

a bar having an arcuate face thereon substantially concentric to said cylindrical core means.

9. The mop, as recited in claim 1, wherein a single engagement of said roller means with said absorbent material removes approximately 95% of the absorbable material in response to an input force of approximately 3 pounds.

10. The mop, as recited in claim 8, wherein said bar and web member are integral.

* * * * *